US007681764B2

(12) United States Patent
Nini

(10) Patent No.: US 7,681,764 B2
(45) Date of Patent: Mar. 23, 2010

(54) DELIVERING TAP AND PROCESS FOR MANUFACTURING SUCH TAP

(75) Inventor: Diego Nini, Alessandria (IT)

(73) Assignee: Vitop Moulding S.R.L., Alessandria (IT)

( * ) Notice: Subject to any disclaimer, the term of this patent is extended or adjusted under 35 U.S.C. 154(b) by 1170 days.

(21) Appl. No.: 10/556,173

(22) PCT Filed: Aug. 2, 2005

(86) PCT No.: PCT/IT2005/000465

§ 371 (c)(1),
(2), (4) Date: Nov. 8, 2005

(87) PCT Pub. No.: WO2006/030465

PCT Pub. Date: Mar. 23, 2006

(65) Prior Publication Data

US 2006/0261099 A1 Nov. 23, 2006

(30) Foreign Application Priority Data

Sep. 13, 2004 (IT) ..... TO2004A0612

(51) Int. Cl.
*B67D 3/00* (2006.01)

(52) U.S. Cl. ..... 222/519; 222/153.05; 222/153.06; 222/541.6; 222/548

(58) Field of Classification Search ..... 222/518–519, 222/505, 516, 546–548, 559, 541.5, 567, 222/105, 153.05, 153.06, 541.6; 251/342, 251/346, 347, 351; 137/383, 797

See application file for complete search history.

(56) References Cited

U.S. PATENT DOCUMENTS

| | | | | |
|---|---|---|---|---|
| 4,351,455 | A * | 9/1982 | Bond | 222/153.14 |
| 4,478,242 | A * | 10/1984 | Bond | 137/383 |
| 4,619,377 | A | 10/1986 | Roos | 222/83 |
| 4,884,705 | A * | 12/1989 | Debetencourt | 215/250 |
| 5,111,970 | A * | 5/1992 | Rutter et al. | 222/83 |
| 5,839,611 | A * | 11/1998 | Obadia et al. | 222/153.14 |
| 6,126,045 | A * | 10/2000 | Last | 222/501 |
| 6,446,845 | B1 * | 9/2002 | Steiger | 222/509 |
| 7,077,294 | B2 * | 7/2006 | Nusbaum et al. | 222/153.06 |
| 7,311,229 | B1 * | 12/2007 | Wrigley | 222/518 |

FOREIGN PATENT DOCUMENTS

| | | |
|---|---|---|
| EP | 0 171 870 | 4/1985 |
| FR | 2 619 612 | 8/1987 |
| WO | WO 01/02283 A1 | 1/2001 |

* cited by examiner

*Primary Examiner*—Frederick C. Nicolas
(74) *Attorney, Agent, or Firm*—David A. Farah; Sheldon Mak Rose & Anderson PC

(57) ABSTRACT

A delivering tap for a liquid vessel of the "bag in box" type, and a process for making the delivering tap, where the delivering tap has a substantially-cylindrical elongated body equipped with an end cam and a plane abutting member against the vessel; and further has a plug with a cylindrical end and an operating knob operatively connected to the body where the plug is made in a single piece, where the plug has a tamper-preventing warranty seal adapted to signal a possible tampering of the tap when opening; and where the body has a housing adapted to contain the tamper-preventing warranty seal.

4 Claims, 8 Drawing Sheets

PRIOR ART

DELIVERING TAP AND PROCESS FOR MANUFACTURING SUCH TAP

CROSS-REFERENCE TO RELATED APPLICATIONS

The present Application is a national phase application of International Patent Application PCT/IT2005/00465, titled "Delivering Tap and Process for Manufacturing Such Tap," filed Aug. 2, 2005, which claims priority from Italian Patent Application No. TO2004A000612 filed Sep. 13, 2004, the contents of which are incorporated in this disclosure by reference in their entirety.

FIELD OF THE INVENTION

The present invention refers to a delivering tap and to a process for manufacturing such tap, in particular to a process for manufacturing the plug of such tap.

BACKGROUND

Taps are known in the art for delivering liquids, in particular of the type used for vessels called "bag in box." Such vessels are composed of two external boxes, usually made of cardboard, inside which there is a bag containing the liquid to be delivered, to which bag usually a mouth, which is used for anchoring and constraining the delivering tap, is thermally welded.

An example of such prior art tap 50 is shown in FIG. 8 and is marketed by Conro Precision in Cape Town, South Africa. The tap 50 is applied to the bag with liquid, by inserting the body inside it through the above-described mouth and, upon using it by the end user, it is made to go out of the cardboard box through a hole, opened by operating on a pre-dinked part for such purpose. Then the tap 50 itself is actuated, by rotating the plug 52 with which it is equipped around a cam end 56.

These taps 50, though being simple from the constructive point of view, however have two types of deficiencies:

1) they are not equipped with warranty elements or seals, which signal tampering or unauthorized access attempts; and 2) the plug 52 with which they are composed is made of two parts (52, 54), thereby increasing the number of pieces and the end product cost, which instead, due to its manufacturing simplicity, should be kept as low as possible. Plugs are marketed in which the part 54 is not placed on the part 52, but such plugs have aesthetic problems, since in this way the injection spot of the part 52 remains visible from the outside.

SUMMARY OF THE INVENTION

Object of the present invention is solving the above prior art problems, by providing a delivering tap which is equipped with warranty seals that state its lack of unauthorized opening and is at the same time equipped with a head made of a single piece, reducing the number of pieces and the related end cost. Such tap, moreover, being of a shorter thickness, removes problems of anomalous shrinkages of plastic materials, with a consequent better quality warranty of the molded piece and the end product (complete tap), in addition to liquid tightness.

A further object of the present invention is providing a tap of the above-mentioned type which is equipped, in at least two of its critical points, with sealing surfaces that allow a seal which is at least the same as the one available in nowadays known plugs.

A further object of the present invention is providing a tap of the above-mentioned type, whose head is realized through an injection molding process, which in this case is innovative and allows removing one piece from the end product, optimizing manufacturing costs and times. Such molding further allows improving the tap aesthetic appearance, since it almost completely reduces (making it unable to be perceived) the injection spot that in the prior art had to be covered by part 54.

A further object of the present invention is providing a tap of the above-mentioned type which is equipped of a particular geometry of the plug sliding cam, which is improved with respect to the prior art.

The above and other objects and advantages of the invention, as will appear from the following description, are reached by a delivering tap and by a process for manufacturing such tap as claimed in the respective independent claims. Preferred embodiments and non-trivial variations of the present invention are the subject matter of the dependent claims.

BRIEF DESCRIPTION OF THE DRAWINGS

The present invention will be better described by some preferred embodiments thereof, provided as a non-limiting example, with reference to the enclosed drawings, in which.

DETAILED DESCRIPTION OF PREFERRED EMBODIMENTS

Figure 1:
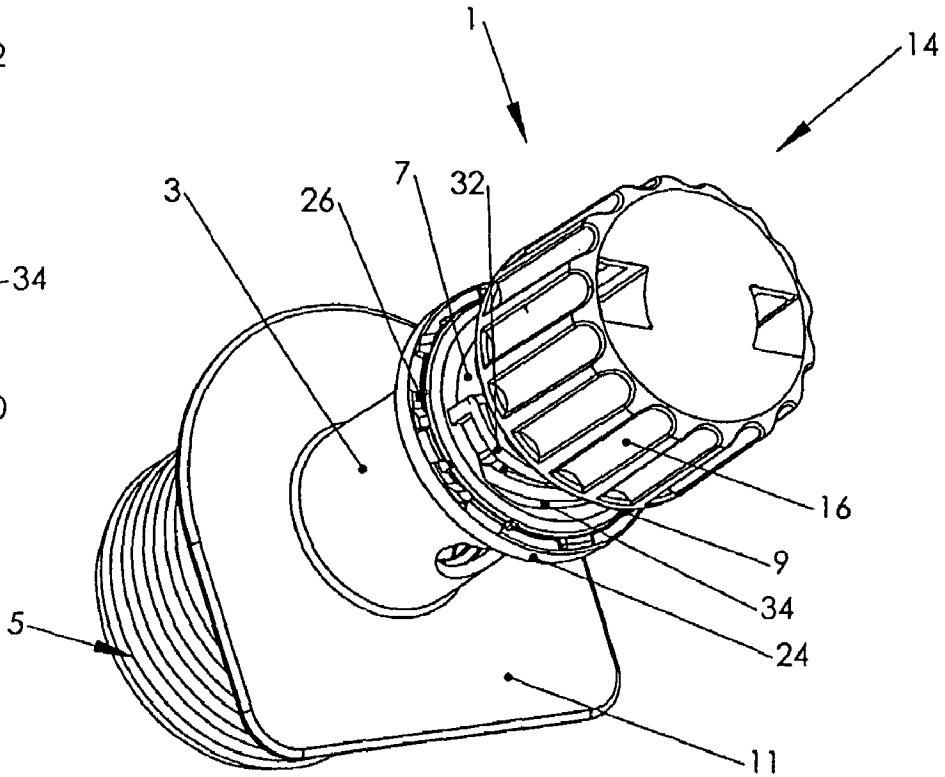
FIG. 1 is a perspective view of an embodiment of the tap according to the present invention in an open position.
Figure 2:
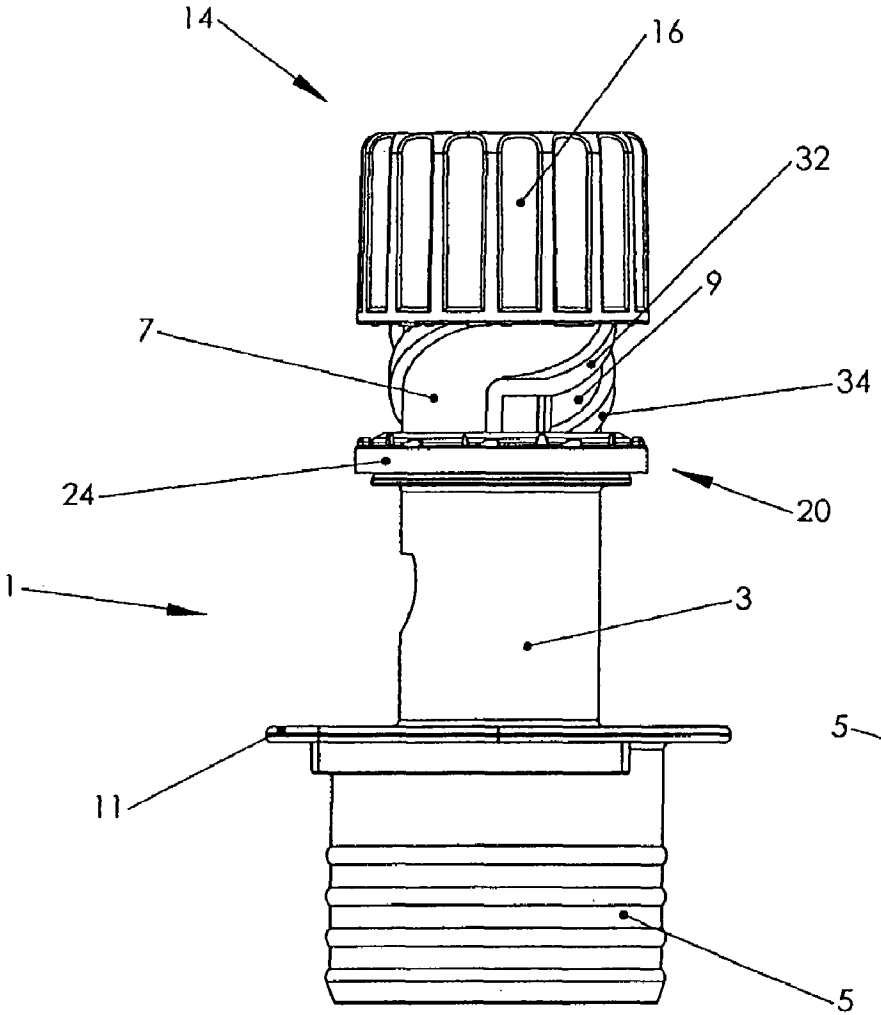
FIG. 2 is a side view of the tap of FIG. 1.
Figure 3:
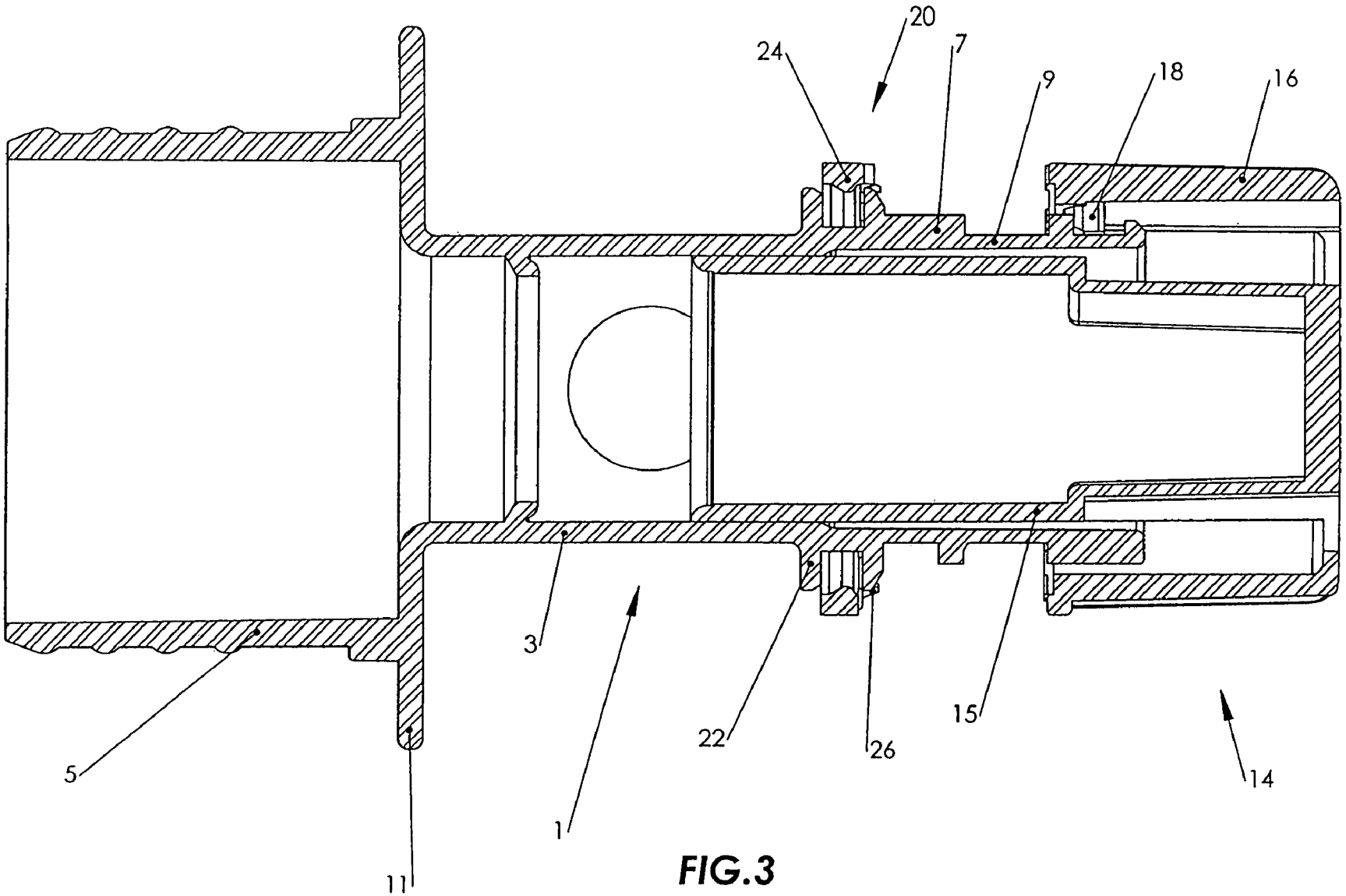
FIG. 3 is a sectional view of the tap of FIGS. 1 and 2.
Figure 4:
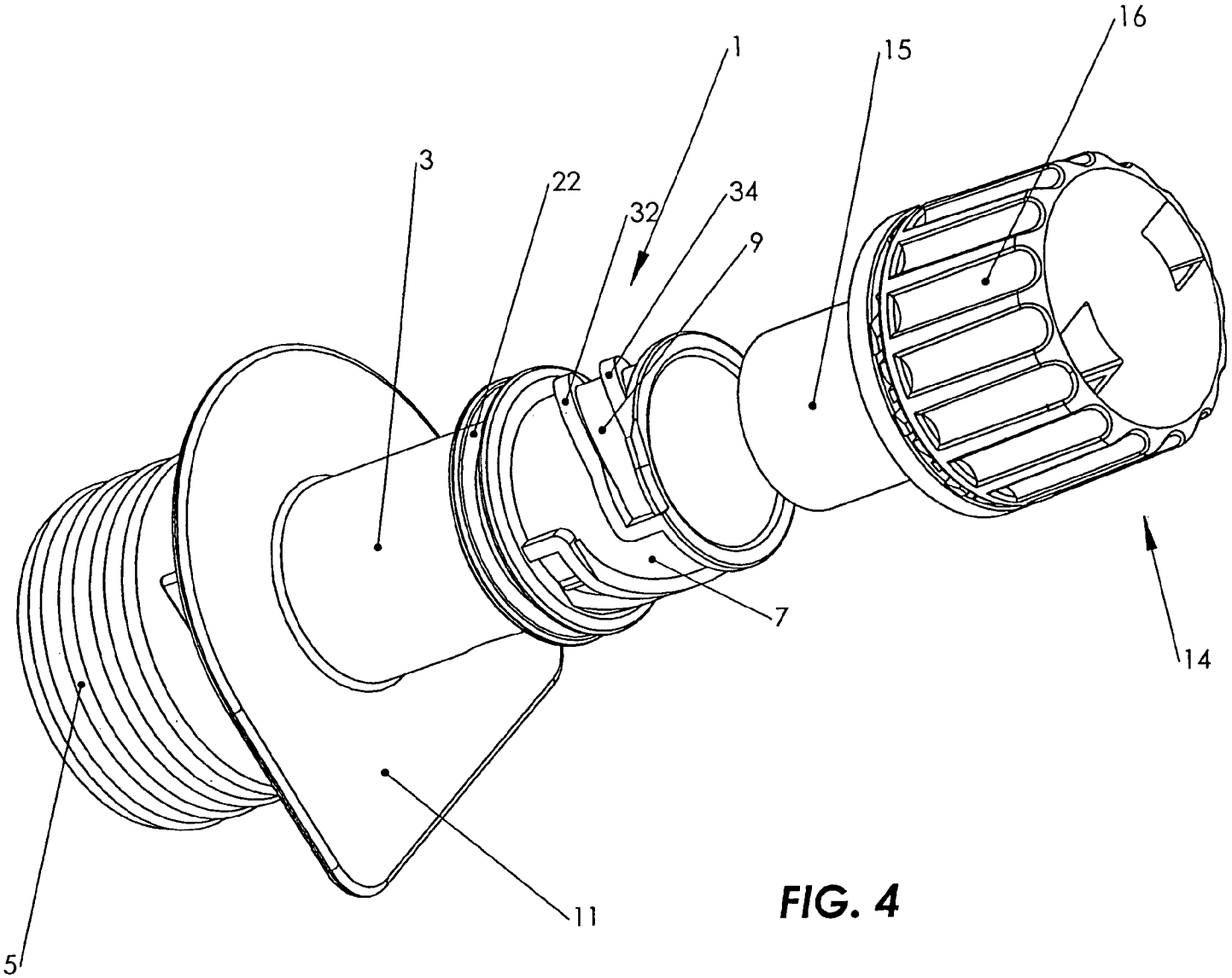
FIG. 4 is an exploded perspective view of the tap of FIG. 1.
Figure 5:
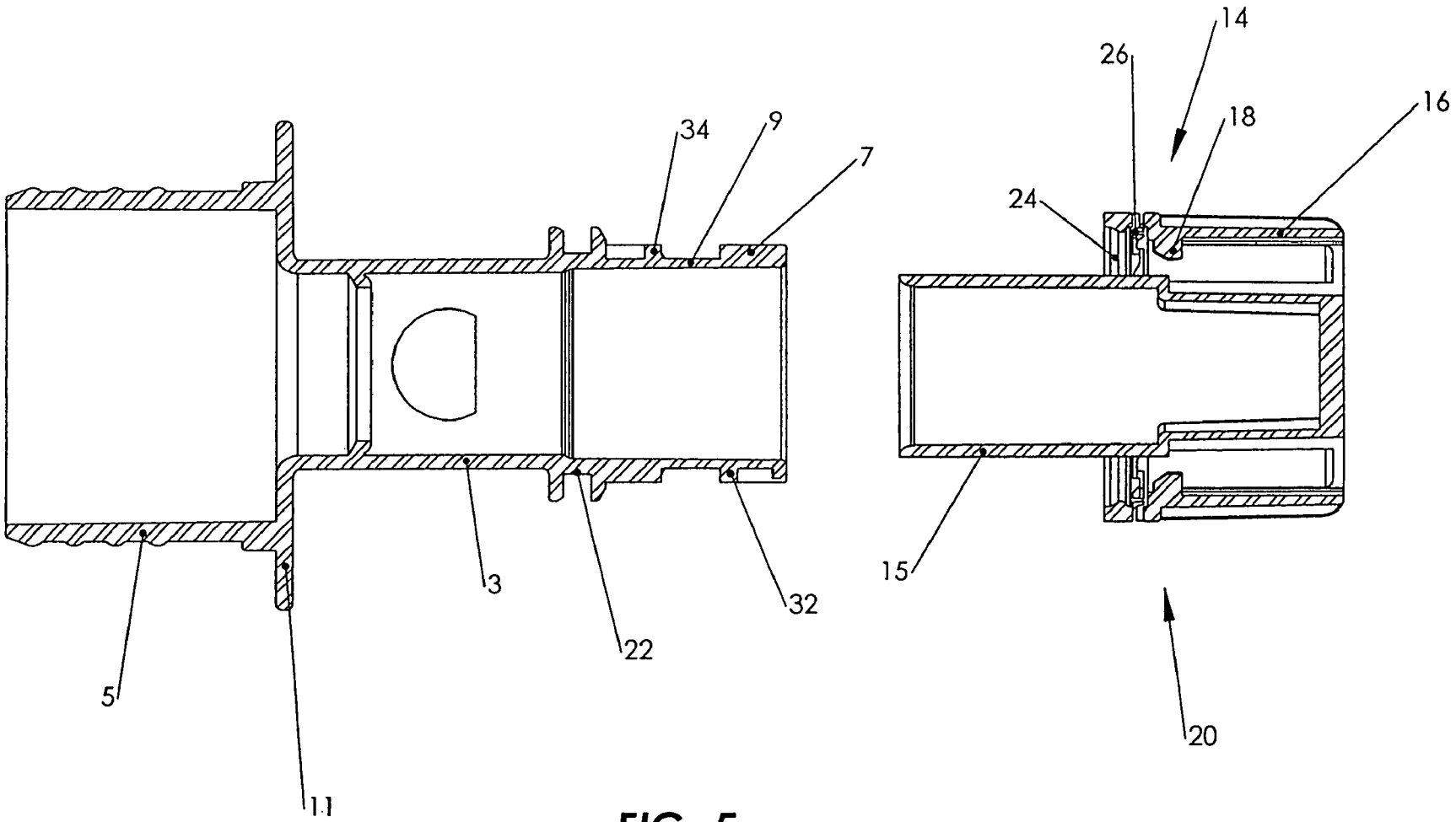
FIG. 5 is a sectional view of the tap of FIG. 4.
Figure 6:
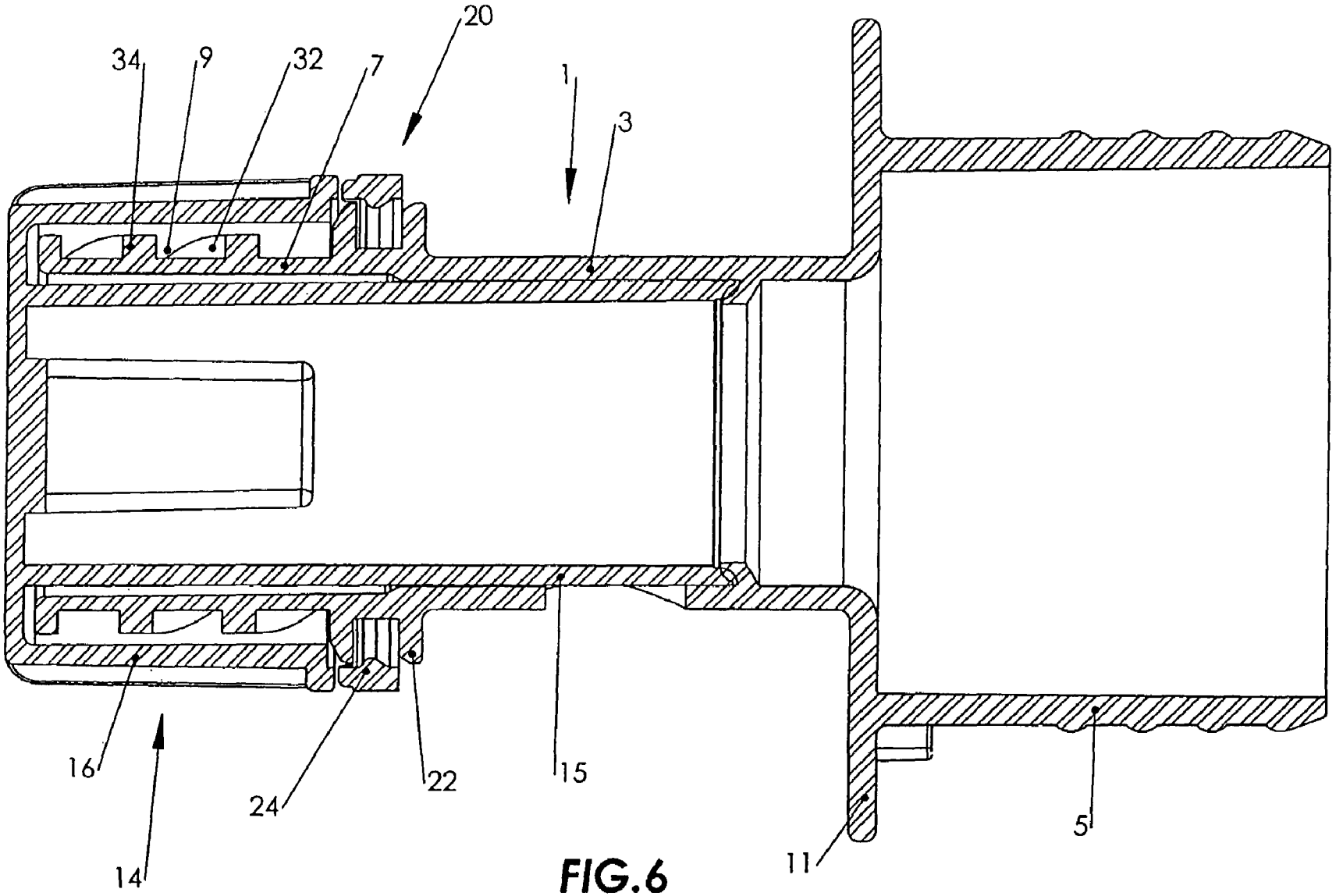
FIG. 6 is a sectional view similar to FIG. 3, but with the tap in a closed position.

With reference to the Figures, a preferred embodiment of the tap of the present invention is shown and described. It will be immediately obvious that numerous variations and modifications (for example related to shape, sizes and parts with equivalent functionality) can be made to the described tap, without departing from the scope of the invention as appears from the enclosed claims.

According to the Figures, the improved delivering tap 1 of the invention, particularly for a liquid vessel of the ""bag in box"" type (not shown), substantially comprises:

- a substantially-cylindrical elongated body 3 equipped with an end 5 comprising rings adapted to perform a seal on a mouth (not shown) with which the vessel bag is equipped, and with an opposite end 7 comprising cam means 9, in which the elongated body 3 further comprises a planar member 11 placed in a plane which is perpendicular to an axis of the body 3; and
- a plug 14 comprising a cylindrical end 15 and an operating knob 16 equipped with engaging means 18 of the cam means 9, in which the plug 14 is adapted to be operatively connected to the end 7 of the body 3 in order to assume, upon a driving from the cam means 9, an opening position in which liquid contained in the vessel is delivered and a closing position of the vessel.

The major characteristics of the inventive delivering tap 1 are that the plug 14 is made in a single piece; the plug 14 is equipped with tamper-preventing warranty sealing means 20 adapted to signal a possible tampering when opening the tap; and the body 3 is equipped with housing means 22 adapted to contain the tamper-preventing warranty sealing means 20.

In particular, but not in a limiting way, as shown, the tamper-preventing warranty sealing means 20 are composed of at least one ring 24 which surrounds the cylindrical end 15 and is connected to the knob 16 through a plurality of connecting members 26: such connecting members 26 are adapted to be detached from the knob 16 and/or the ring 24 upon firstly rotating the plug 14 when opening.

Moreover, the housing means 22 of the tamper-preventing warranty sealing means 20 are composed of at least one groove adapted to immovably house the ring 24.

A tap can be thereby realized which is inexpensive, easy to assemble and which guarantees the end user with respect to authenticity of delivered liquid, demonstrating the lack of its tampering when there is the related seal.

The tap 1 as described above weighs less than the prior art taps, given the lower use of material (plastics) of which it is composed and given the presence of a shorter molding cycle.

Figure 7:
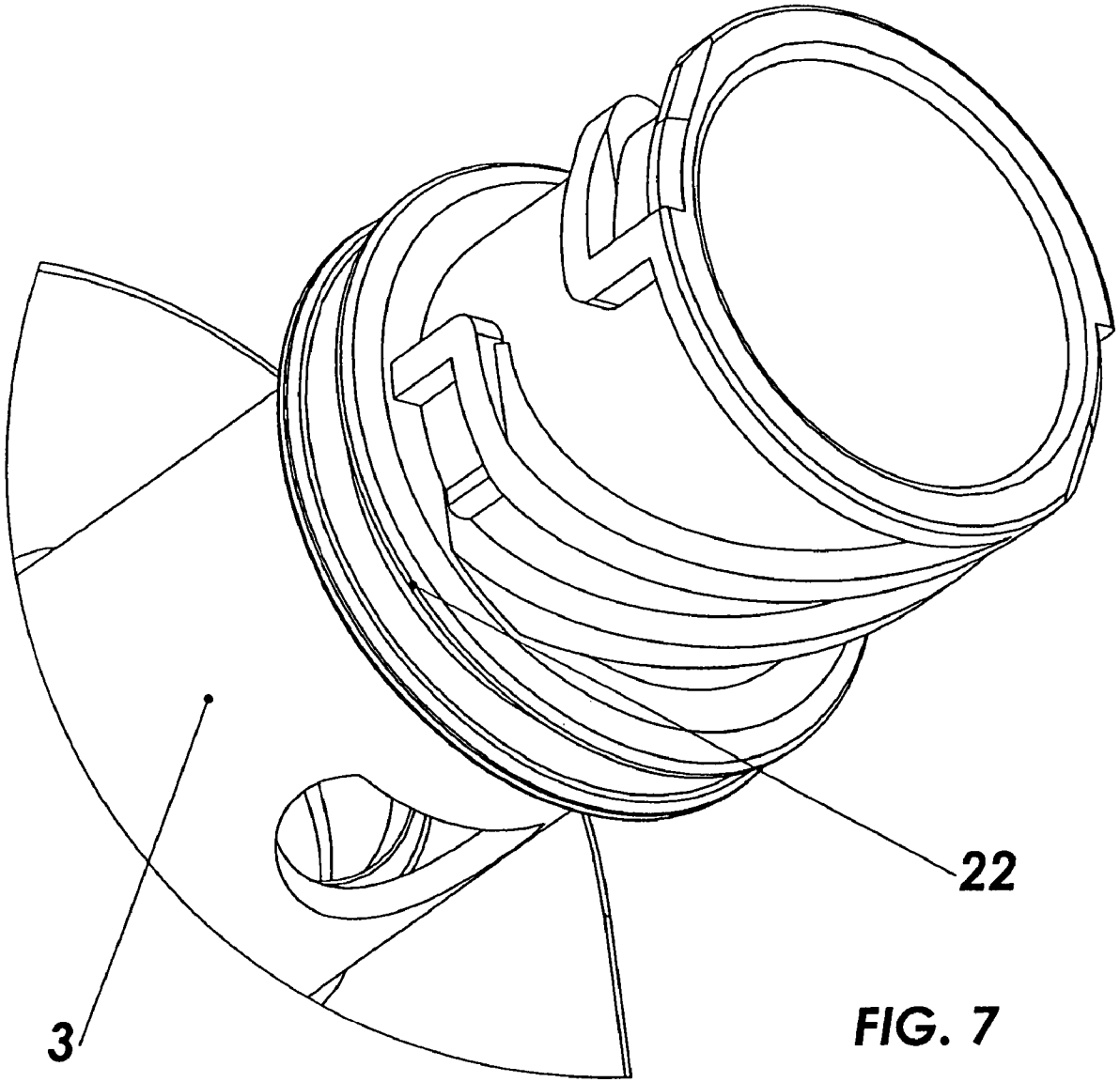
FIG. 7 is a detailed view of the actuating cam of the inventive tap.
Figure 8:
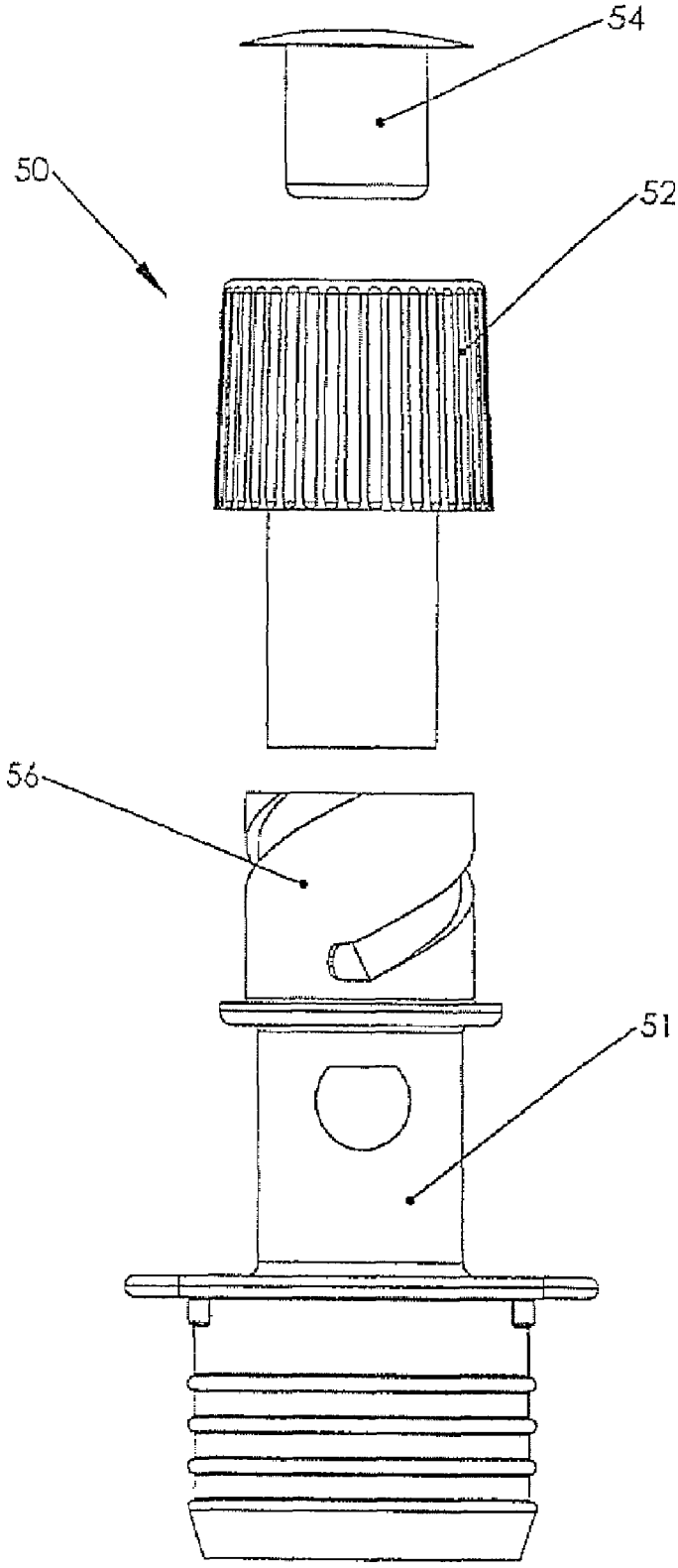
FIG. 8 is an exploded side view of a prior art tap.

Moreover, FIG. 7 shows a detail of the geometry of the cam 9 of the body 3 of the inventive tap 1. Such cam 9 is lightened with respect to the one in known taps, which further optimizes the amount of used material and therefore the related molding cycles, which, by becoming quicker, also optimize the manufacturing costs. Moreover, such geometry decreases the thicknesses (important aspect in this type of taps) decreasing the risk of anomalous post-molding shrinkages, with consequent improvement of piece quality, above all in the area that can be found near the front area, which is the most important for the liquid seal. Lightening of the cam 9 is obtained by building the cam 9 itself through two walls 32, 34 projecting outwards from the surface of the end 7 of the body 3 and spirally wound around the end 7 itself. Such end 7 is thereby made with the same diameter of the corresponding parts of prior art taps 50 (for example, see reference 56 in FIG. 8), but discharging, with respect to prior art taps 50, the cylindrical cam areas which were previously made thick. In practice, the thickness of the inventive cam 9 allows avoiding anomalous shrinkages, while the two walls 32, 34 have been made to grow by a necessary amount to allow the accurate and safe sliding of the small tooth, which will transform the rotary movement also in a translating movement, and allows opening the plug through an accurate sliding.

Figure 11:
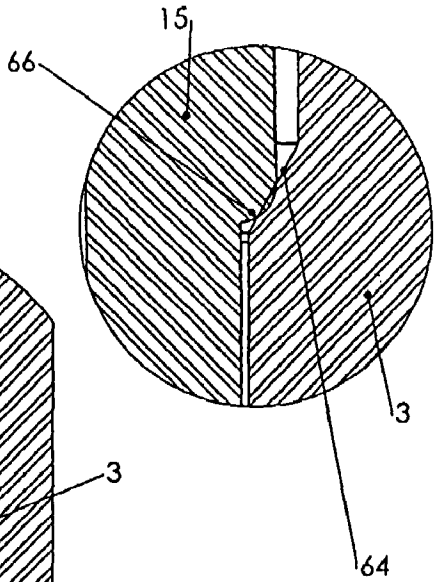
FIG. 11 is a further detailed view of FIG. 9.
Figure 10:
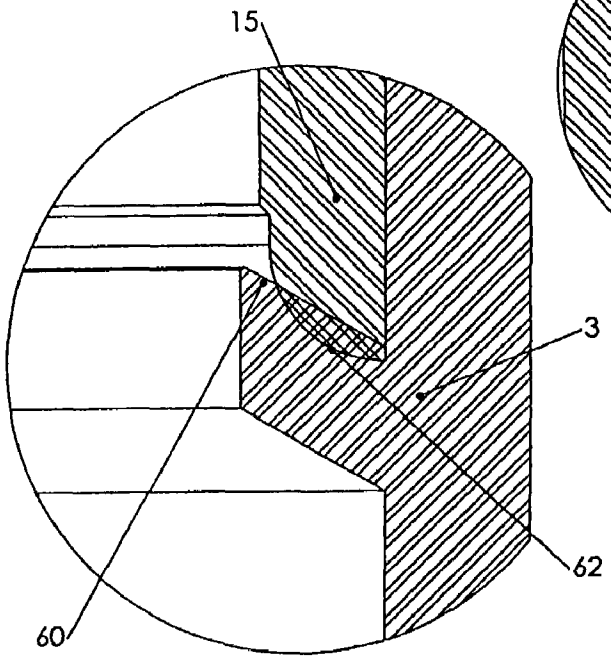
FIG. 10 is a detailed view of FIG. 9.
Figure 9:
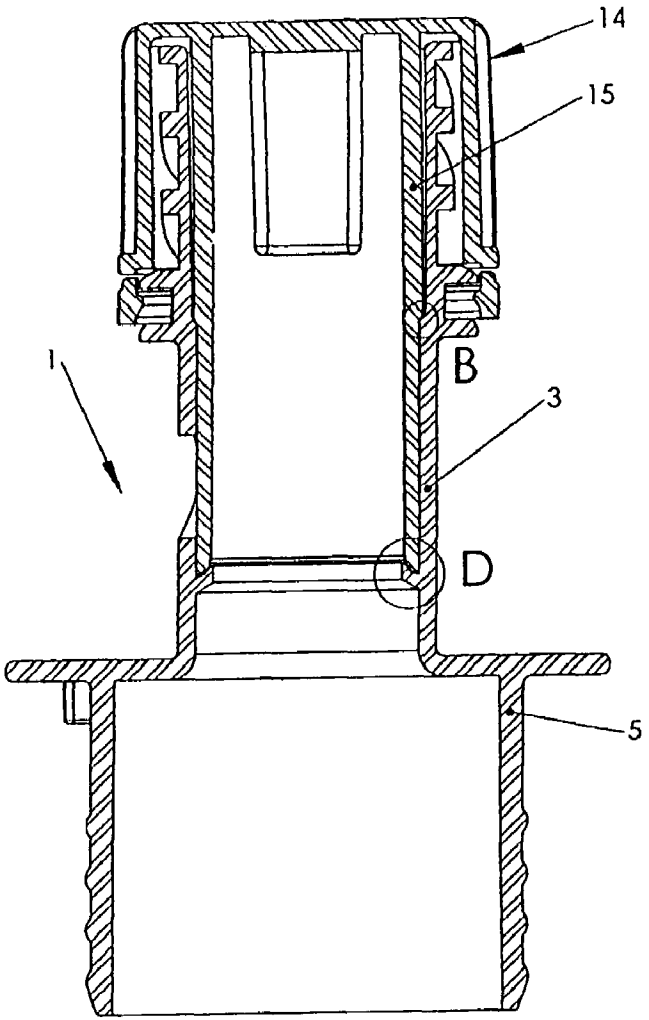
FIG. 9 is a sectional view of the inventive tap which points out a sealing variation thereof.

Moreover, in order to guarantee an optimum seal at least equal to the one guaranteed by known taps, the inventive tap 1 provides, in addition to the mutual operating engagement of body 3 and cylindrical end 15 through their respective elongated cylindrical surfaces which guarantee an optimum seal every time, also the fact that the body 3 and the cylindrical end 15 of the plug 14 are in mutual contact in at least two sealing points (B, D in FIG. 9). As can be well seen in FIGS. 10 and 11, in each one of the sealing points (B, D), the body 3 surface in contact with the cylindrical end 15 is plane and the cylindrical end 15 surface in contact with the body 3 is spherical. This guarantees a further seal in critical positions of the tap 1.

As mentioned above, the inventive tap 1 also provides realizing the related plug 14 in a single piece, reducing the number of component parts and improving the aesthetics (and above all reducing or removing some manufacturing steps) such as the injection spots that are present in prior art taps. The process which allows manufacturing such plug 14 in a single piece provides the use of an injection-molding process whose use in this field is wholly new. Such process, first of all, provides, in order to make the body 3, common injection-molding steps of the body 3 itself.

The process further comprises, in order to mold the plug 14, the steps of:

- providing an injection mold (not shown) composed of two half-molds, in which one of the half-molds is fixed and has inserted an injector or injecting bush (not shown), while another of the half-molds is movable and has inserted an expulsion device (not shown): the plug 14 to be molded is placed next to the separation surface between the half-molds;
- closing the injection mold;
- performing the injection of material for making the plug 14;
- opening the mold, firstly next to a separating area of the half-molds;
- moving the movable half-mold away;
- simultaneously with the step of moving the movable half-mold away, dragging outwards the saddles, connected, through slanted pegs, to the movable half-mold, which saddles are used for making the sealing means 20, thereby freeing the sealing means 20;
- simultaneously with dragging the saddles, freeing a front part of the plug 14, since to the fixed half-mold a female member is connected, which remains unmoving, and therefore goes away from the moving half-mold (not shown), in which two insert members are inserted (which, being integral with the female member will remain inserted in the female member itself and unmoving on the fixed mold side), whose function is creating, during coupling with the external male part (not shown) being present on the movable half-mold, the internal teeth of the knob 16 of the plug 14 and to tear away an end part of the injection spot (not shown);
- simultaneously to freeing, dragging, through the movable half-mold and by means of a connecting member between the two half-molds, the intermediate male part (not shown) being present on the fixed mold part, by means of a mold plate (not shown), thereby realizing a first forward advancement of the plug 14;
- going on opening the mold, a hydraulic extractor (not shown), connected to a rear mold area, will operate on mold members adapted to completely free the plug 14 from the inserts being present on the fixed half-mold; and
- completing the mold closure through the hydraulic extractor which, being anchored to the rear mold part through a threaded bar (not shown), drags in an opposite movement various plates and small tables completing the closure.

Some preferred embodiments of the present invention have been previously shown and described: obviously, numerous variations and modification, functionally equivalent to the previous ones, will be immediately clear to the skilled people in the art and will fall within the scope of the invention as pointed out by the enclosed claims. For example, the tap 1, previously shown in a version with horizontal installation and use (namely, delivery) with respect to the box-shaped vessel to which it is applied, can also be realized in a version with horizontal installation but vertical use (namely, delivery), by only suitably configuring the outlet plug in a known way (and therefore not shown). It is obvious that what has been described can be equally well applied to this further version of the inventive tap.

What is claimed is:

1. A delivering tap for a liquid vessel, the delivering tap comprising:

a) a substantially-cylindrical elongated body equipped with an end comprising sealing rings, and with an opposite end comprising cam means, the elongated body further comprising a planar member placed in a plane which is perpendicular to an axis of the body; and b) a plug comprising a front part, a cylindrical end and an operating knob equipped with engaging means of the cam means, the plug being adapted to be operatively connected to the end of the body in order to assume, when driving the cam means, an opening position in which liquid contained in the vessel is delivered and a closing position of the vessel;

where the plug is made in a single piece;

where the plug is equipped with tamper-preventing warranty sealing means adapted to signal a possible tampering when opening the tap;

where the body is equipped with housing means adapted to contain the tamper-preventing warranty sealing means; and where the cam comprises two walls, the walls being projecting outside a surface of the end of the body and being spirally wound around the end of the body.

2. A delivering tap according to claim 1, where the body has a surface;

where the cylindrical end of the plug has a surface;

where the surface of the body and the surface of the cylindrical end of the plug are in mutual contact in two or more than two sealing points; and where in each one of the sealing points the surface of the body in contact with the cylindrical end is plane and the surface of the cylindrical end in contact with the body is spherical.

3. A delivering tap for a liquid vessel, the delivering tap comprising:

a) a substantially-cylindrical elongated body equipped with an end comprising sealing rings, and with an opposite end comprising cam means, the elongated body further comprising a planar member placed in a plane which is perpendicular to an axis of the body; and b) a plug comprising a cylindrical end and an operating knob equipped with engaging means of the cam means, the plug being adapted to be operatively connected to the end of the body in order to assume, when driving the cam means, an opening position in which liquid contained in the vessel is delivered and a closing position of the vessel;

where the plug is made in a single piece;

where the plug is equipped with tamper-preventing warranty sealing means adapted to signal a possible tampering when opening the tap;

where the body is equipped with housing means adapted to contain the tamper-preventing warranty sealing means; and where the tamper-preventing warranty sealing means comprises at least one ring that surrounds the cylindrical end and that is connected to the knob through a plurality of connecting members, the connecting members being adapted to be detached from the knob or the ring or both the knob and the ring upon first rotating the plug when opening.

4. A delivering tap according to claim 3, where the housing means of the tamper-preventing warranty sealing means comprises one or more than one groove adapted to immovably house the ring.

* * * * *